US007085515B2

(12) United States Patent
Bausch et al.

(10) Patent No.: US 7,085,515 B2
(45) Date of Patent: Aug. 1, 2006

(54) DEVELOPER CARTRIDGE INCLUDING SEALING GASKET

(76) Inventors: Michael E. Bausch, c/o Applied Mechanical Technologies, Inc., 7931 Rae Blvd., Victor, NY (US) 14564; Mary A. Dailor, c/o Applied Mechanical Technologies, Inc., 7931 Rae Blvd., Victor, NY (US) 14564; David H. Hudson, c/o Applied Mechanical Technologies, Inc., 7931Rae Blvd., Victor, NY (US) 14564; Scott W. Miller, c/o Applied Mechanical Technologies, Inc., 7931 Rae Blvd., Victor, NY (US) 14564; Michael L. Schneier, c/o Applied Mechanical Technologies, Inc., 7931 Rae Blvd., Victor, NY (US) 14564; Martin P. Schooping, c/o Applied Mechanical Technologies, Inc., 7931 Rae Blvd., Victor, NY (US) 14564

( * ) Notice: Subject to any disclaimer, the term of this patent is extended or adjusted under 35 U.S.C. 154(b) by 0 days.

(21) Appl. No.: 11/115,362

(22) Filed: Apr. 27, 2005

(65) Prior Publication Data

US 2005/0196191 A1 Sep. 8, 2005

Related U.S. Application Data

(63) Continuation of application No. 10/616,906, filed on Jul. 11, 2003, now Pat. No. 6,907,208.

(60) Provisional application No. 60/421,081, filed on Oct. 25, 2002.

(51) Int. Cl.
*G03G 15/08* (2006.01)

(52) U.S. Cl. ..... 399/106

(58) Field of Classification Search ..... 399/103, 399/108, 258, 262, 106
See application file for complete search history.

(56) References Cited

U.S. PATENT DOCUMENTS

| | | | | |
|---|---|---|---|---|
| 5,555,080 | A | 9/1996 | Elich et al. | |
| 5,974,286 | A | 10/1999 | Ban et al. | |
| 5,999,770 | A | 12/1999 | Li | |
| 6,269,234 | B1 | 7/2001 | Kurz et al. | |
| 6,628,914 | B1 | 9/2003 | Wang et al. | |
| 6,668,145 | B1 | 12/2003 | Wang et al. | |
| 6,907,208 | B1 * | 6/2005 | Bausch et al. | 399/262 |

FOREIGN PATENT DOCUMENTS

| | | |
|---|---|---|
| JP | 4-336565 | 11/1992 |
| JP | 7-20681 | 5/1995 |
| JP | 9-120206 | 6/1997 |

* cited by examiner

*Primary Examiner*—Susan Lee
(74) *Attorney, Agent, or Firm*—Oblon, Spivak, McClelland, Maier & Neustadt, P.C.

(57) ABSTRACT

A developer cartridge for containing a developer and for delivering the developer to a developer hopper of an electrophotographic machine. A developer containment portion includes a first portion having an at least partially closed volume configured to contain the developer and a second portion adjacent the first portion and having an opening configured to deliver the developer to the developer hopper. A sealing gasket is disposed adjacent the second portion of the developer containment portion and surrounds at least a portion of a circumference of the opening. A first cover is disposed adjacent the second portion of the developer containment portion and is positionable between an open position for delivery of the developer and a closed position for preventing delivery of the developer. The sealing gasket contacts the first cover to prevent undesired leakage of the developer therebetween.

23 Claims, 5 Drawing Sheets

DEVELOPER CARTRIDGE INCLUDING SEALING GASKET

CROSS-REFERENCE TO RELATED APPLICATION

This application claims the benefit of priority to U.S. provisional application No. 60/421,081 to Bausch et al., filed Oct. 25, 2002, the disclosure of which is incorporated by reference herein in its entirety.

BACKGROUND OF THE INVENTION

1. Field of the Invention

The present invention relates to a developer cartridge, and more particularly to a developer cartridge including a sealing gasket that, in conjunction with one or more covers, can prevent an undesired leakage of a developer contained therein.

2. Discussion of the Related Art

It is a known that in an electro-photographic (EP) machine (e.g., a photocopier, a facsimile machine, or a printer), a developer (e.g., a one component or a two component toner composed of fine particles) forms a developer image on a recording media (e.g., a sheet of paper or a transparent sheet) during an image forming process of the EP machine. The EP machine includes a main unit having a developer hopper that stores the developer consumed during the image forming process. A known or conventional developer cartridge, which contains the developer, is mounted to the developer hopper, and delivers the developer from the developer cartridge to the developer hopper. After delivery of the developer, the developer cartridge is dismounted from the developer hopper. Thus, the developer that forms the developer image on the recording media and therefore is consumed during the image forming process is replenished, and the EP machine performs a subsequent image forming process.

The known or conventional developer cartridge includes, among other components, a developer containment portion that contains the developer, an engagement flange that is integrally formed with the developer containment portion and that engages a corresponding portion of the developer hopper during the mounting and delivery, and a removable film that is adhered to a portion of the developer containment portion and/or to a portion of the engagement flange and that prevents delivery of the developer from the developer containment portion until the removable film is removed therefrom. The removable film, which is generally a polyethylene film, is adhered by thermal or ultrasonic welding and/or by the use of an adhesive. Prior to any attempt to mount the developer cartridge to the developer hopper, the adhered removable film forms a seal that prevents an undesired leakage of the developer.

The known developer cartridge also includes a pull tab that is operatively connected to the removable film as well as one or more covers of the developer cartridge. Actuation of the pull tab, after the mounting of the developer cartridge to the developer hopper, unadheres and moves the removable film and the one or more covers from a closed position that prevents delivery of the developer to an open position that permits delivery of the developer. Thus, the previously adhered removable film is unsealed from the developer cartridge.

Although a relatively large majority of the volume of the developer is successfully delivered from the developer cartridge to the developer hopper, a relatively small volume of the developer invariably is not delivered to the developer hopper and therefore remains in the developer cartridge. Before dismounting the developer cartridge from the developer hopper, the removable film and the one or more covers are moved from the open position to the closed position in an attempt to prevent the undesired leakage. However, because the removable film has been unsealed from the developer cartridge, and is not re-adhered thereto, the removable film does not prevent the undesired leakage when the developer cartridge is dismounted from the developer hopper. Thus, it is desirable to provide a developer cartridge that can prevent the undesired leakage of the developer when the developer cartridge is dismounted from the developer hopper of the EP machine.

SUMMARY OF THE INVENTION

The present invention provides a developer cartridge for containing a developer and for delivering the developer to a developer hopper of an electro-photographic machine. A developer containment portion includes a first portion having an at least partially closed volume configured to contain the developer and a second portion adjacent the first portion and having an opening configured to deliver the developer to the developer hopper. A sealing gasket is disposed adjacent the second portion of the developer containment portion and surrounds at least a portion of a circumference of the opening. A first cover is disposed adjacent the second portion of the developer containment portion and is positionable between an open position for delivery of the developer and a closed position for preventing delivery of the developer. The sealing gasket contacts the first cover to prevent undesired leakage of the developer therebetween.

The present invention further provides a developer cartridge for containing a developer and for delivering the developer to a developer hopper of an electro-photographic machine. A developer containment component includes a component for containing the developer and a component for delivering the developer to the developer hopper. A component for sealing is disposed adjacent the component for delivering the developer. A first cover component is disposed adjacent the component for delivering the developer and is positionable between an open position for delivery of the developer and a closed position for preventing delivery of the developer. The component for sealing contacts the first cover to prevent undesired leakage of the developer therebetween.

The present invention further provides a method for delivering a developer contained in a developer cartridge to a developer hopper of an electro-photographic machine. A first cover is directly moved from a closed position to prevent delivery of the developer to an open position to deliver the developer. A second cover in contact with the developer is indirectly moved from the closed position to the open position via first cooperating features of the first and second covers. In a still further preferred embodiment of the invention, the first cover is directly moved from the open position to the closed position, and the second cover is indirectly moved from the open position to the closed position via second cooperating features of the first and second covers.

BRIEF DESCRIPTION OF THE DRAWINGS

A more complete appreciation of the present invention, and many of the attendant advantages thereof, will be readily ascertained and/or obtained as the same becomes better understood by reference to the following detailed description when considered in connection with the accompanying drawings, wherein.

DETAILED DESCRIPTION OF THE PREFERRED EMBODIMENT(S)

Figure 1:
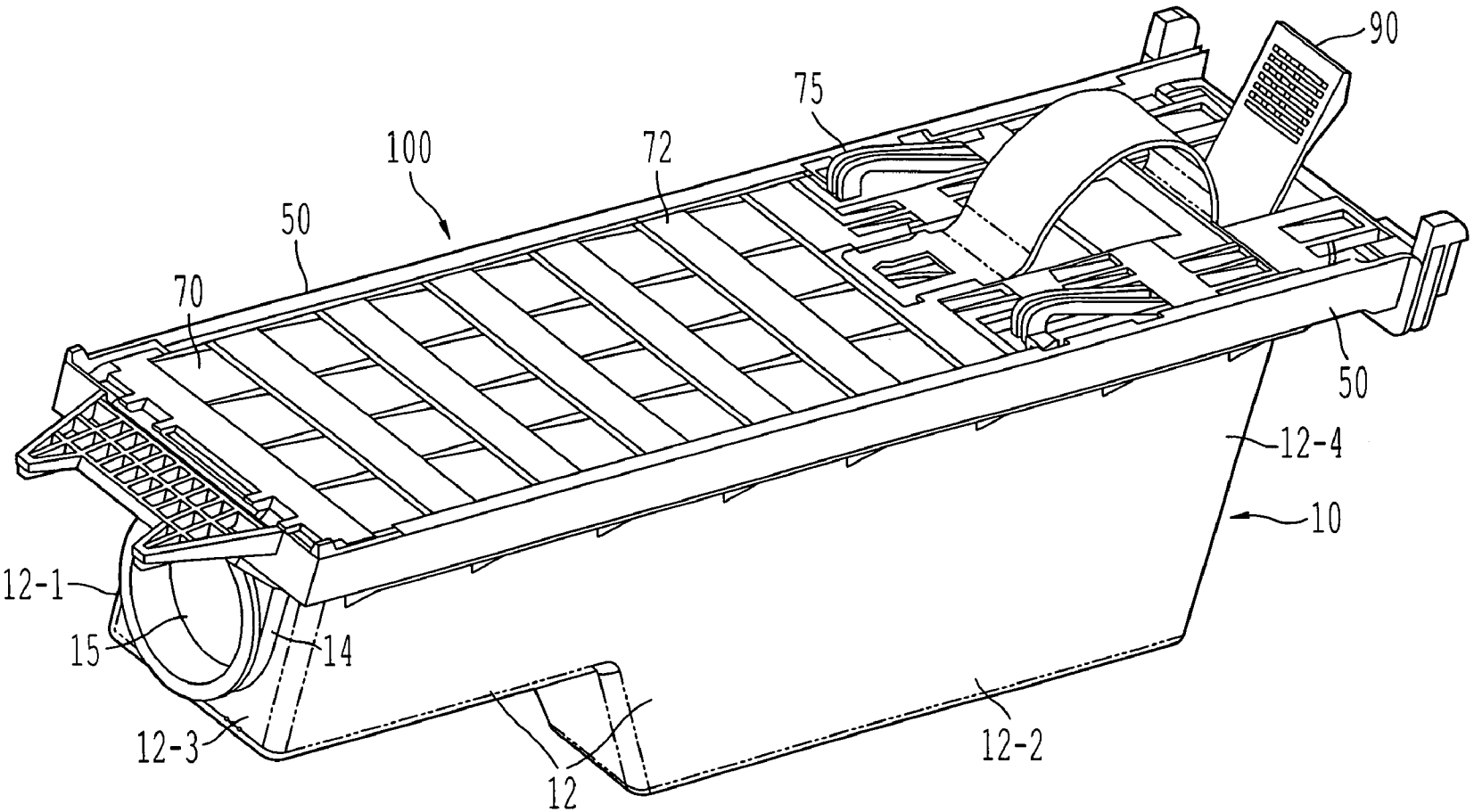
FIG. 1 shows a top isometric view of the developer cartridge of the present invention.
Figure 2:
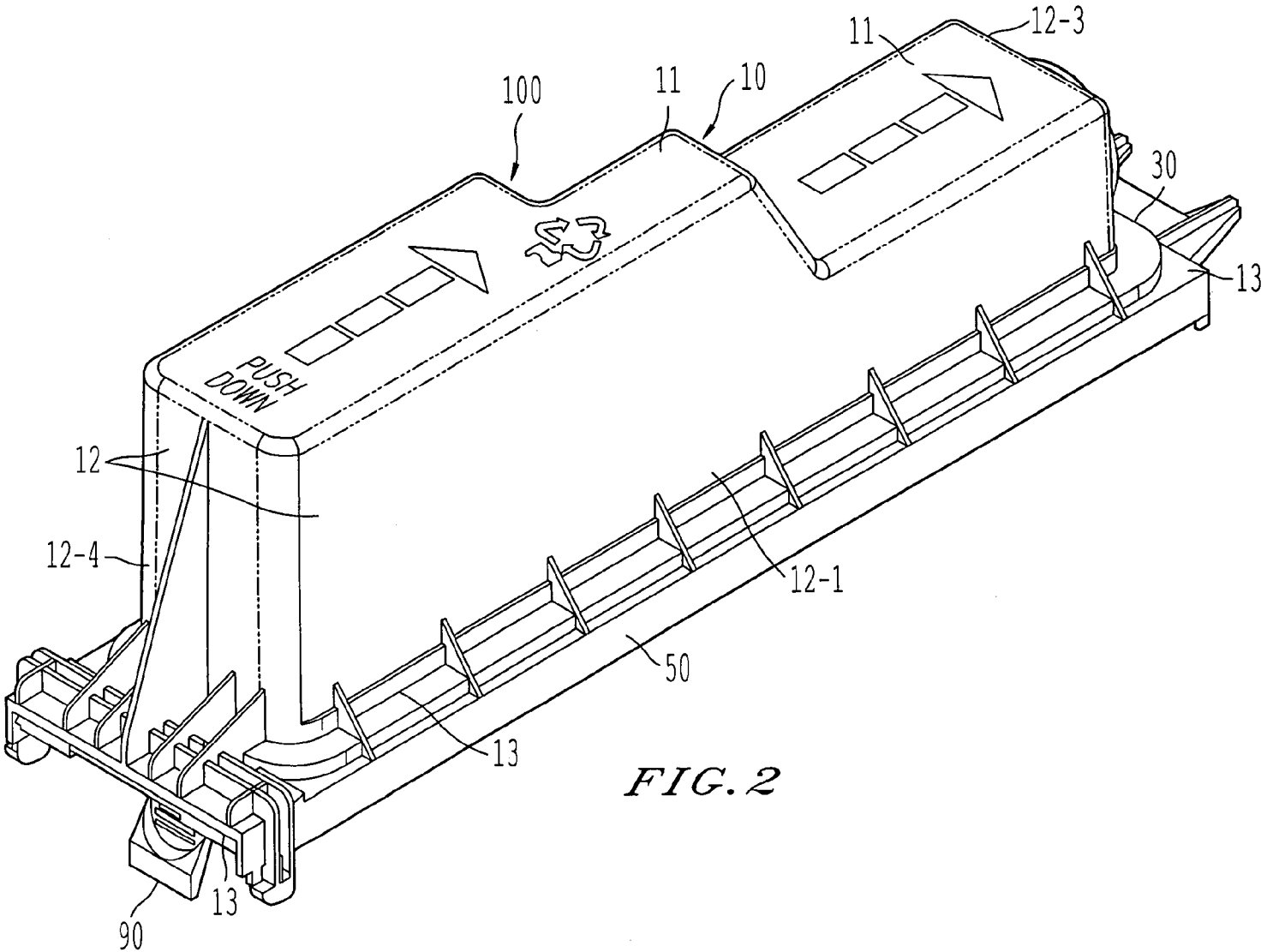
FIG. 2 shows a bottom isometric view of the developer cartridge of FIG. 1
Figure 3:
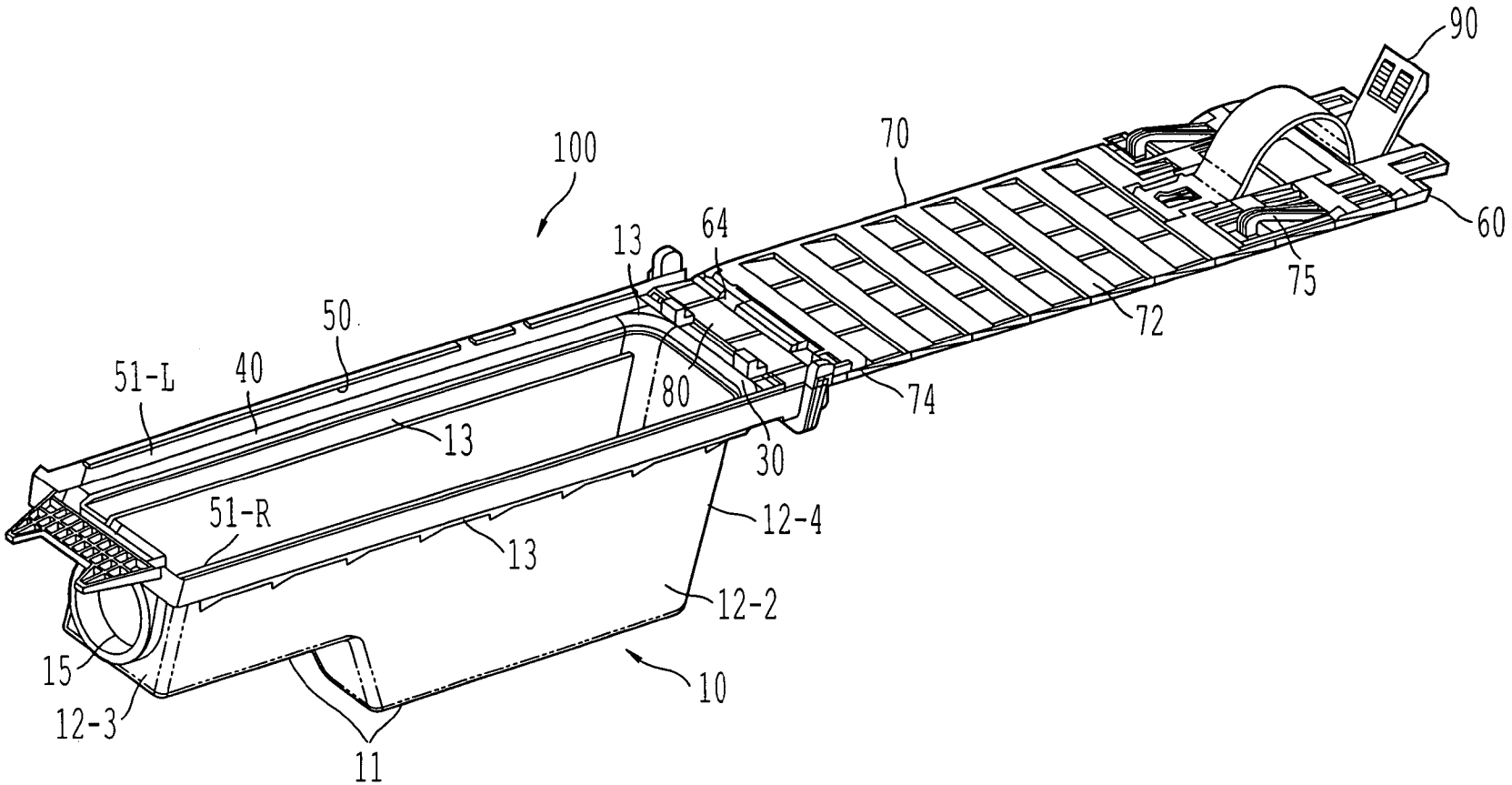
FIG. 3 shows a top isometric view of the developer cartridge of FIG. 1 with the bottom and top covers 60 and 70 in an open position.
Figure 4A:
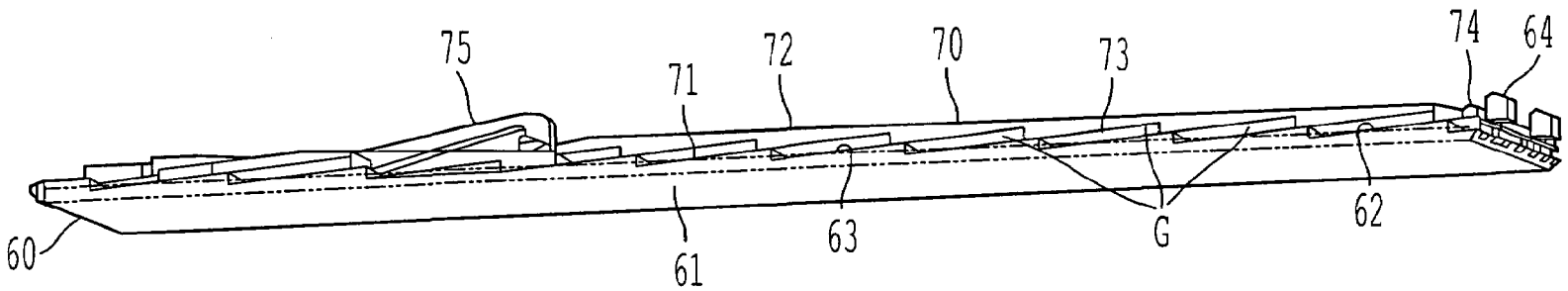
FIGS. 4A and 4B show side isometric views of the bottom and top covers 60 and 70 including cooperating features in the closed and open position, respectively.
Figure 4B:
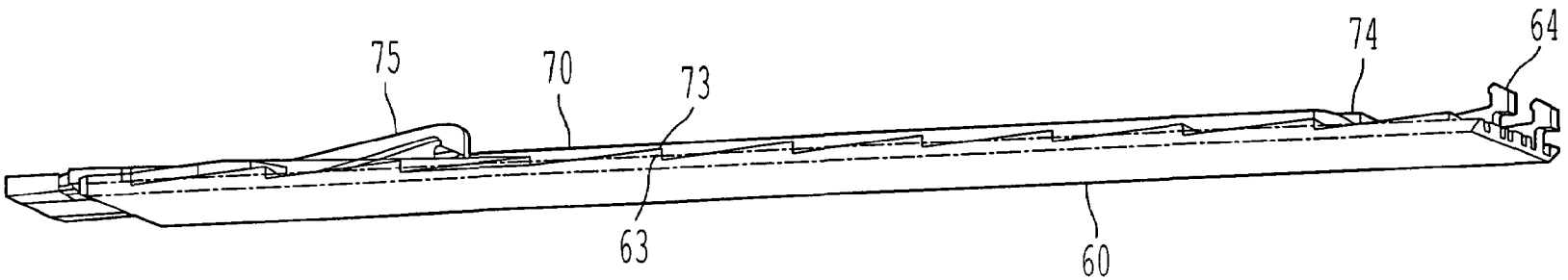
Figure 5A:
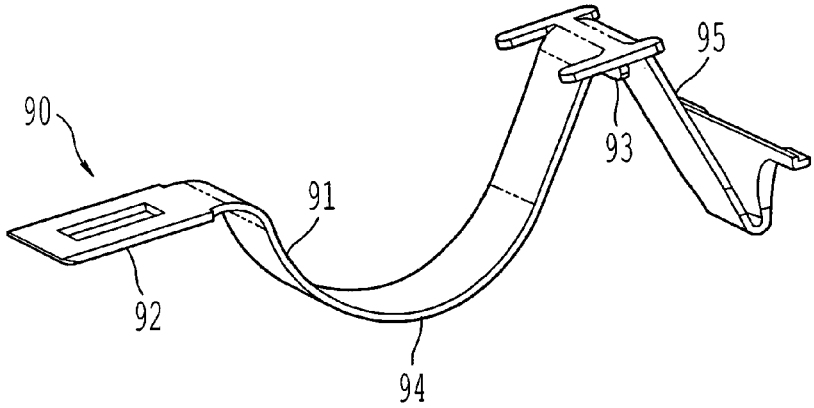
FIGS. 5A, 5B, and 5C show side isometric views of embodiments of pull handles according to the present invention.
Figure 5B:
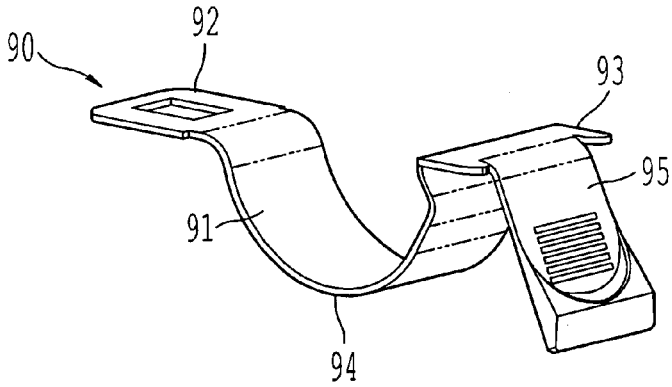
Figure 5C:
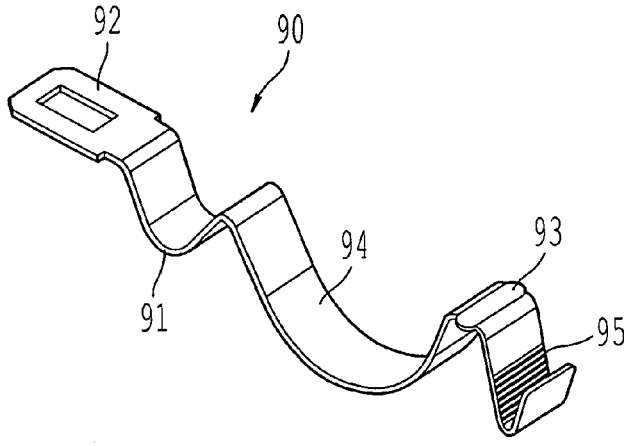

Examples of one or more preferred embodiments of the present invention will now be described with reference to the drawings, wherein like reference numbers throughout the several views identify like and/or similar elements.

The present invention is directed to a developer cartridge that can deliver a developer (e.g., a one or a two component toner composed of fine particles) to a developer hopper of a main unit of an electro-photographic (EP) machine (e.g., a photocopier, a facsimile machine, or a printer). During an image formation process of the EP machine, the main unit can form a developer image on a surface of a recording media (e.g., a sheet of paper or a transparent sheet), thereby consuming a volume of the developer contained in the developer hopper. The developer cartridge, which contains the developer, is mounted to the developer hopper, and delivers the developer from the developer cartridge to the developer hopper. After delivery of the developer, the developer cartridge is dismounted from the developer hopper.

The developer cartridge of the present invention can include a sealing gasket that, in conjunction with one or more covers, can prevent an undesired leakage of the developer (i) prior to the mounting of the developer cartridge to the developer hopper, (ii) after the mounting of the developer cartridge to the developer hopper, before and/or after opening the one or more covers to deliver the developer to the developer hopper, and/or (iii) after closing the one or more covers to prevent further delivery of the developer to the developer hopper, before and/or after the dismounting of the developer cartridge from the developer hopper. The undesired leakage can be prevented without the use of a sealing film.

As shown in the drawings, the developer cartridge 100 of the present invention can include, among other components, a developer containment portion 10, a sealing gasket channel 30, a sealing gasket 40, a covers' channel 50, a bottom cover 60, a top cover 70, a developer wiper 80, and a pull handle 90, which can be used to prevent the undesired leakage, as described below.

The developer containment portion 10 can contain the developer and can deliver the developer to the developer hopper (not shown). Although certain preferred embodiments of the developer containment portion 10 are shown in the drawings, it is to be understood that the developer containment portion 10 can be of any type, so long as the developer containment portion 10 can contain the developer and can deliver the developer.

The containment portion 10 can include a bottom portion 11, left, right, front, and back side portions 12-1 to 12-4, respectively, and a top portion 13. The bottom and side portions 11 and 12-1 to 12-4 can include a plurality of walls that define an at least partially closed volume for containing the developer. The particular size, shape, orientation, and/or contours of the developer containment portion 10, including the bottom and side portions 11 and 12-1 to 12-4, can be selected such that a desired amount of the developer can be contained in the developer containment portion 10, a desired amount of developer can be delivered to the developer hopper, and/or the developer cartridge 100 can be conveniently mounted and/or dismounted relative to the developer hopper.

One or more of the bottom and side portions 11 and 12-1 to 12-4 can include a developer filling orifice 14 for (i) filling the developer cartridge 100 prior to an initial use (e.g., prior to an initial delivery of a volume of the developer from the developer cartridge 100 to the developer hopper), and/or (ii) refilling the developer cartridge 100 after an initial use (e.g., subsequent to a delivery of at least some volume of the developer from the developer cartridge 100 to the developer hopper). An orifice cap 15, which can be opened and closed to permit and to prohibit the filling and/or the refilling of the developer cartridge 100 through the developer filling orifice 14, respectively, can be disposed in the developer filling orifice 14. In a preferred embodiment of the invention, at least one of the side portions 12-1 to 12-4 can include the developer filling orifice 14 and the orifice cap 15, and in a more preferred embodiment the front side portion 12-3 can include the developer filling orifice 14 and the orifice cap 15.

The top portion 13 can include an open portion for delivery of the developer to the developer hopper. In a preferred embodiment of the invention, the open portion can have a cross-sectional area that is about equal to a cross-sectional area of a projection of the partially closed volume for containing the developer of the bottom and side portions 11 and 12-1 to 12-4.

In a preferred embodiment of the invention, the top portion 13 can include the sealing gasket channel 30 in which the sealing gasket 40 can be disposed, the covers' channel 50 in which the bottom and top covers 60 and 70, respectively, can be disposed, and/or the developer wiper 80 (to be described in detail below).

The sealing gasket 40, in conjunction with the one or more covers (e.g., the bottom and top covers 60 and 70), can prevent the undesired leakage of the developer (i) prior to the mounting of the developer cartridge 100 to the developer hopper, (ii) after the mounting of the developer cartridge 100 to the developer hopper, before and/or after the opening of the one or more covers to deliver the developer to the developer hopper, and/or (iii) after the closing of the one or more covers to prevent further delivery of the developer to the developer hopper, before and/or after the dismounting of the developer cartridge 100 from the developer hopper. The undesired leakage can be prevented without the use of a sealing film. Thus, although certain preferred embodiments of the sealing gasket 40 are shown in the drawings, it is to be understood that the sealing gasket 40 can be of any type, so long as the sealing gasket 40, in conjunction with the one or more covers (e.g., the bottom and top covers 60 and 70), can prevent the undesired leakage, and/or can prevent the undesired leakage without the use of the sealing film.

The sealing gasket 40 can surround at least a portion of a circumference of the open portion of the top portion 13 through which the developer can be delivered to the developer hopper. In a preferred embodiment of the invention, the sealing gasket 40 can surround about an entire circumference of the open portion. However, it is to be understood that the sealing gasket 40 can surround a portion of any circumference of the open portion, so long as the sealing gasket 40, in conjunction with the one or more covers (e.g., the bottom and top covers 60 and 70), can prevent the undesired leakage.

The sealing gasket 40 can have a cross-sectional shape that is one or more of about circular, elliptical, and/or polygonal. In a preferred embodiment of the invention, the sealing gasket 40 can be about polygonal in cross-section, and in a more preferred embodiment, can be about rectangular in cross-section, and in a still more preferred embodiment, can be about square in cross-section. The sealing gasket 40 can include one or more seal pieces. In a preferred embodiment of the invention, the sealing gasket 40 can include one seal piece. The sealing gasket 40 can include an elastically compressible material. In a preferred embodiment, the sealing gasket 40 can include an elastic foam. However, it is to be understood that the sealing gasket 40 can have any cross-section, can include any number of seal pieces, and/or can include material, so long as the sealing gasket 40, in conjunction with the one or more covers (e.g., the bottom and top covers 60 and 70), can prevent the undesired leakage.

The sealing gasket channel 30 can receive and/or retain the sealing gasket 40. Although certain preferred embodiments of the sealing gasket channel 30 are shown in the drawings, it is to be understood that the sealing gasket channel 30 can be of any type, so long as the sealing gasket channel 30 can receive and/or can retain the sealing gasket 40. Alternatively, the sealing gasket channel 30 can be omitted from the developer cartridge 100.

The sealing gasket channel 30 can be formed in the top portion 13 of the developer containment portion 10. The sealing gasket channel 30 can be in the form of a groove that surrounds at least a portion of the circumference of the opening portion of the top portion 13 and receives and/or retains a least a portion of a length of the sealing gasket 40. In a preferred embodiment of the invention, when the sealing gasket 40 surrounds about the entire circumference of the open portion, the sealing gasket channel 30 can surround about the entire circumference of the open portion, and can receive and/or retain about the entire length of the sealing gasket 40. In a more preferred embodiment, the sealing gasket channel 30 can have a C-shaped cross-section and can include two side surfaces that can be about parallel to one another and can include a third side surface that can extend between and can be about perpendicular to the two side surfaces.

The covers' channel 50 can permit the opening of the one or more covers (e.g., the bottom and top covers 60 and 70) for delivery of the developer from the developer cartridge 100 to the developer hopper, and can permit the closing of the one or more covers to prevent further delivery of the developer from the developer cartridge 100 to the developer hopper. The covers' channel 50 can permit contact to be achieved and maintained between the sealing gasket 40 and the one or more covers (e.g., the bottom and top covers 60 and 70) to prevent the undesired leakage of the developer (i) prior to the mounting of the developer cartridge 100 to the developer hopper, (ii) during and/or after the mounting of the developer cartridge 100 to the developer hopper, and/or (iii) during and/or after the dismounting of the developer cartridge 100 from the developer hopper. The covers' channel 50 can permit contact to be achieved and maintained between and/or among the one or more covers (e.g., the bottom and top covers 60 and 70), such that opening and closing of the top cover 70 can result in a corresponding opening and closing of the bottom cover 60 for delivery and to prevent further delivery of the developer from the developer cartridge 100 to the developer hopper. Thus, although certain preferred embodiments of the covers' channel 50 are shown in the drawings, it is to be understood that the covers' channel 50 can be of any type, so long as the covers' channel 50 can permit contact to be achieved and maintained between the sealing gasket 40 and the one or more covers (e.g., the bottom and top covers 60 and 70) to prevent the undesired leakage of the developer, and/or such that the covers' channel 50 can permit contact to be achieved and maintained between and/or among the one or more covers (e.g., the bottom and top covers 60 and 70), such that opening and closing of the top cover 70 can result in the corresponding opening and closing of the bottom cover 60.

The covers' channel 50 can be integral with the developer containment portion 10, and in a preferred embodiment of the invention, can be integral with the top portion 13 of the developer containment portion. The covers' channel 50 can extend about an entire length of one or more of the side portions 12-1 to 12-4 of the developer containment portion 10, and can include a left channel 51-L and a right channel 51-R that can extend about the entire length of the left and right sides 12-1 and 12-2 of the developer containment portion 10, respectively. In a preferred embodiment of the invention, each of the left and right channels 51-L and 51-R of the covers' channel 50 can have a C-shaped cross-section and can include a bottom surface that can be disposed proximate to the top portion 13 and a top surface that can be disposed opposite to the bottom surface and away from the top portion 13, respectively, and a side surface that can extend between the top and bottom surfaces. The bottom and top surfaces can be about parallel to each other, and the side surface can be about perpendicular to the bottom and top surfaces.

One or more surfaces of the covers' channel 50 can include one or more voids for aligning with a corresponding feature of the developer hopper and/or other structure of the EP machine. In a preferred embodiment of the invention, the top surfaces of each of the left and right channels 51-L and 51-R can include a plurality of voids that can align with corresponding protrusions of the developer hopper, such that the mounting of an developer cartridge that is not suitable for use with the particular EP machine can be prevented.

The bottom cover 60, in conjunction with the sealing gasket 40, with or without the top cover 70, can prevent the undesired leakage of the developer from the developer cartridge 100. Thus, although certain preferred embodiment of the bottom cover 60 are shown in the drawings, it is to be understood that the bottom cover 60 can be of any type, so long as the bottom cover 60, in conjunction with the sealing gasket 40, can prevent the undesired leakage.

The bottom cover 60 can be disposed in the covers' channel 50 proximate to the top portion 13 of the developer containment portion 10. By this arrangement, the bottom cover 60 can be disposed proximate and in contact with the sealing gasket 40.

Thus, it is to be understood that the geometry of one or more of the other portions of the developer cartridge 100 can be configured such that the bottom cover 60 can achieve and can maintain contact with the sealing gasket 40, such that the undesired leakage can be prevented. Specifically, the bottom cover 60 and the sealing gasket 40 can be installed, such that when the bottom cover 60 is in the closed position preventing delivery of the developer through the top portion 13, the sealing gasket 40 can be compressed between the top portion 13 and the bottom cover 60, thereby preventing the undesired leakage therebetween. The bottom cover 60 and the sealing gasket 40 can be installed such that when the bottom cover 60 is in the open position for delivery of the developer from the developer cartridge 100 to the developer hopper, at least a portion of the length of the sealing gasket 40 can be compressed between the bottom cover 60 and the top portion 13, thereby preventing the undesired leakage therebetween. The undesired leakage can be prevented without the use of a sealing film.

The bottom cover 60 can include a bottom surface 61 that can be proximate to the top portion 13 of the developer containment portion 10 and can include a top surface 62 that can be opposite to the bottom surface 61 and can be proximate to an exterior of the developer cartridge 100 and/or can be proximate to the top cover 70.

The bottom surface 61, which can face the developer containment portion 13 and therefore can contact the developer stored therein, can be about smooth to minimize a volume of developer adhering thereto. When the bottom cover 60 is opened for delivery of the developer from the developer cartridge 100 to the developer hopper, the sealing gasket 40 that is in contact with the bottom surface 61 can prevent adherence of the developer to the bottom cover 60 at locations on the bottom cover 60 that have traveled over the sealing gasket 40. Thus, the developer can be prevented from adhering to a portion of the bottom surface 61 that is exposed to the exterior of the developer cartridge 100. The left and rights edges of the bottom surface 61 can include at least one of a radius, a chamfer, and a taper, at a portion of the edges that is disposed within the left and right channels 51-L and 51-R of the covers' channel 50. Similarly, when the bottom cover 60 is closed to prevent further delivery of the developer, the sealing gasket 40 can remain in contact with the bottom surface 61, thereby preventing a formation of a gap therebetween through which the undesired leakage can occur.

The top surface 62 can include one or more cooperating features, and can include one or more sets of cooperating features, that can cooperate with one or more corresponding features of the top cover 70, such that the opening and the closing of the bottom cover 60 for delivery and the for preventing further delivery of the developer from the developer cartridge 100 to the developer hopper can be facilitated (discussed in detail below).

The top surface 62 can include one or more cooperating features 63 that can facilitate the opening of the one or more covers (e.g., the bottom and top covers 60 and 70) for delivery of the developer. In a preferred embodiment of the invention, the top surface 62 can include one or more cooperating features 63, and in a more preferred embodiment, can include a plurality of (i.e., two (2) or more) cooperating features 63, and in a still more preferred embodiment, can include at least eleven (11) cooperating features 63. The eleven (11) cooperating features can be in the form of stepped portion 63, and can be in the form of hollow stepped portions 63. The cooperating features 63 can cooperate with corresponding cooperating features of the top cover 70, such that in the closed position, the corresponding cooperating features of the bottom and top covers 60 and 70 can be separated by a gap "G" and an overall height of the bottom and top cover 60 and 70 can be maximized, and an overall height of the sealing gasket 40 can be minimized. When the top cover 70 is initially moved relative to the bottom cover 60 at the beginning of the opening of the bottom and top covers 60 and 70, the cooperating features 63 of the bottom cover 60 can cooperate with cooperating features of the top cover 70, such that the corresponding cooperating features of the bottom and top covers 60 and 70 can be in contact with one another and can achieve a minimum overall height of the bottom and top covers 60 and 70, and to permit a maximum overall height of the sealing gasket 40 to be achieved. Thus, it is to be understood that a force required to open the developer cartridge 100 can be at a maximum when the bottom and top covers 60 and 70 are closed (due to the minimum overall height of the sealing gasket 40 pushing against the bottom and top covers 60 and 70), and the opening thereof has begun, and can be minimized shortly after the opening of the bottom and top covers 60 and 70 (due to the maximum overall height of the sealing gasket 40 pushing against the bottom and top covers 60 and 70) has begun.

The top surface 62 can include one or more cooperating features 64 that can facilitate the closing of the one or more covers (e.g., the bottom and top covers 60 and 70) to prevent the further delivery of the developer. In a preferred embodiment of the invention, the top surface 62 can include one or more cooperating features 64, and in a more preferred embodiment, can include a plurality of (i.e., two (2) or more) cooperating features 64. The plurality of cooperating features can be in the form of two key protrusions 64. The cooperating features 64 can cooperate with corresponding cooperating features of the top cover 70, such that when the top cover 70 is initially moved from the open position to the closed position, the cooperating features 64 of the bottom cover 60 can cooperate with the cooperating features of the top cover 70. Thus, it is to be understood that the closing of the top cover 70 can result in the closing of the bottom cover 60. The cooperating features 64 of the bottom cover 60 can also unlock a shield member (not shown) of the developer hopper, the shield member preventing access to the developer hopper of the EP machine in a known or conventional manner.

The top cover 70, in conjunction with the sealing gasket 40 and the bottom cover 60, can prevent the undesired leakage of the developer from the developer cartridge 100. Thus, although certain preferred embodiment of the top cover 70 are shown in the drawings, it is to be understood that the top cover 70 can be of any type, as long as the top cover 70, in conjunction with the sealing gasket 40 and the bottom cover 60, can prevent the undesired leakage. Alternatively, the top cover 70 can be omitted from the developer cartridge 100.

The top cover 70 can be disposed in the covers' channel 50 proximate to the exterior of the developer containment portion 10. By this arrangement, the top cover 70 can be disposed proximate and in contact with the top cover 70. Thus, it is understood that the geometry of one or more of the other portions of the developer cartridge 100 can be configured such that the top cover 70 can achieve and can maintain contact with the bottom cover 60, such that the undesired leakage can be prevented.

The top cover 70 can include a bottom surface 71 that can be proximate to and can face the bottom cover 60 and can include a top surface 72 that can be opposite to the bottom surface 71 and can be proximate to the exterior of the developer cartridge 100. The bottom surface 71 can include one or more cooperating features, and can include one or more sets of cooperating features, that can cooperate with the corresponding cooperating features 63 of the top surface 62 of the bottom cover 60.

The bottom surface 71 can include one or more cooperating features 73 that can facilitate the opening of the bottom and top covers 60 and 70 for delivery of the developer. In a preferred embodiment of the invention, the bottom surface 72 can include one or more cooperating features 73, and in a more preferred embodiment, can include a plurality of (i.e., two (2) or more) cooperating features 73, and in a still more preferred embodiment, can include at least eleven (11) cooperating features 73. The eleven (11) cooperating features can be in the form of stepped portion 73, and can be in the form of hollow stepped portions 73. The cooperating features 73 can cooperate with the corresponding cooperating features 63 of the bottom cover 60, such that in the closed position, the cooperating features 63 and 73 of the bottom and top covers 60 and 70 can be separated by a gap "G" and the overall height of the bottom and top covers 60 and 70 can be maximized, and the overall height of the sealing gasket 40 can be minimized. When the top cover 70 initially moved relative to the bottom cover 60 at the beginning of the opening of the bottom and top covers 60 and 70, the cooperating features 73 of the top cover 70 can cooperate with the corresponding cooperating features 63 of the bottom cover 60, such that the cooperating features 63 and 73 of the bottom and top covers 60 and 70 can be in contact with one another and can achieve the minimum overall height of the bottom and top covers 60 and 70, and permit the maximum overall height of the sealing gasket 40 to be achieved. Thus, it is to be understood that the force required to open the developer cartridge 100 can achieve the maximum when the bottom and top covers 60 and 70 are closed and the opening thereof has begun, and can be minimized shortly after the opening of the bottom and top covers 60 and 70 has begun.

The top cover 70 can include one or more cooperating features 74 that facilitate the closing of the bottom and top covers 60 and 70 that also prevent further delivery of the developer. In a preferred embodiment of the invention, the top cover 70 can include one or more cooperating features 74, and in a more preferred embodiment, can include a plurality of (i.e., two (2) or more) cooperating features 74. The plurality of cooperating features can be in the form of two voids 74 that can extend between the top and bottom surfaces 71 and 72 of the top cover 70. The cooperating features 74 can cooperate with the corresponding cooperating features 64 of the bottom cover 60, such that when the top cover 70 is initially moved from the open position to the closed position, the cooperating features 74 of the top cover 70 can cooperate with the corresponding cooperating features 64 of the bottom cover 60. Thus, it is understood that the closing of the top cover 70 can result in the closing of the bottom cover 60.

The top cover 70 can include one or more dismounting members 75 that can be compressed to store spring energy when the developer cartridge 100 is mounted to the developer hopper, and can deliver the stored spring energy when the developer cartridge 100 is dismounted from the developer hopper, thereby aiding in the removal of the developer cartridge 100 from the developer hopper. Although certain preferred embodiments of the one or more dismounting members 75 are shown in the drawings, it is to be understood that the one or more dismounting members 75 can be of any type, as long as the dismounting members 75 can deliver and store the spring energy. Alternatively, the dismounting members 75 can be omitted from the developer cartridge 100.

In a preferred embodiment of the invention, the top cover 70 can include at least two (2) spring members 75 that can be compressed to store the spring energy and can deliver the stored spring energy. The dismounting members 75 can be disposed in corresponding channels (not shown) of the developer hopper when the developer cartridge 100 is mounted to the developer hopper, such that when the one or more covers (e.g., the bottom and top covers 60 and 70) are opened and closed, the dismounting member 75 can move within the corresponding channels and can remain compressed.

The developer wiper 80 can prevent the developer that adheres to the bottom cover 60 after traveling over the sealing gasket 40 from reaching the exterior of the developer cartridge 100. Although certain preferred embodiments of the developer wiper 80 are shown in the drawings, it is to be understood that the developer wiper 80 can be of any type, as long as the developer wiper 80 can prevent the developer that adheres to the bottom cover 60 from reaching the exterior of the developer cartridge 100. Alternatively, the developer wiper 80 can be omitted from the developer cartridge 100.

The developer wiper 80 can be disposed between a front portion of the top portion 13 (i.e., a portion of the top portion 13 proximate to the front portion 12-3), such that the developer wiper 80 can achieve and maintain contact with the bottom surface 61 of the bottom cover 60. The developer wiper can extend an about entire length between the left and right channels 51-L and 51-R of the covers' channel 50. In a preferred embodiment, the developer wiper 80 can include an elastically compressible material.

The pull handle 90 can be used to move the one or more covers (e.g., the bottom and top covers 60 and 70) from the closed position to the open position to deliver the developer from the developer cartridge 100 to the developer hopper. Although certain preferred embodiments of the pull handle 90 are shown in the drawings, it is to be understood that the pull handle 90 can be in any form, so long as the pull handle 90 can be used to open the one or more covers.

In the embodiments shown in the drawings, the pull handles 90 can include a first connecting portion 91 that can be about U-shaped. The first connecting portion 91 can include a first connector 92 that can connect with a portion of the top cover 70, can include a second connector 93 that can connect with another portion of the top cover 70, and can include a middle portion 94 that connects the first and second connectors 92 and 93. The top cover 70 can include corresponding protrusions and/or voids for achieving an operative connection with the second and first connectors 93 and 92, respectively.

The pull handle 90 can include a handle portion 95 operatively connected with the first connecting portion 91. The handle portion 95 can be sized, shaped, and/or oriented such that the pull handle 90 can be manually and/or automatically actuated to open the one or more covers (e.g., bottom and top covers 60 and 70) from the closed position that prevents delivery of developer to the open position that permits delivery of the developer. The handle portion 95 can be in the form of a T-shape, and/or can be in the form of a thumb tab.

Numerous additional modifications and variations of the present invention are possible in light of the above teachings. It is therefore to be understood that within the scope of the appended claims, the present invention may be practiced otherwise than as specifically described herein.

The invention claimed is:

1. A developer cartridge for containing a developer and for delivering the developer to a developer hopper of an electro-photographic machine, the developer cartridge comprising:

a developer containment means including a means for containing the developer and a means for delivering the developer to the developer hopper;

a means for sealing disposed adjacent the means for delivering the developer; and a first cover means disposed adjacent the means for delivering the developer and positionable in a first direction between an open position for delivery of the developer and a closed position for preventing delivery of the developer, the first cover means configured to move in a second direction different than the first direction during movement between the open and closed positions, wherein the means for sealing contacts the first cover means to prevent undesired leakage of the developer therebetween, and wherein the means for sealing has a first overall height when the first cover means is in the open position and has a second overall height when the first cover means is in the closed position.

2. A method for delivering a developer contained in a developer cartridge to a developer hopper of an electro-photographic machine, the method comprising:

directly moving a first cover along a first direction from a closed position to prevent delivery of the developer to an open position to deliver the developer;

indirectly moving a second cover in contact with the developer along the first direction from the closed position to the open position via first cooperating features of the first and second covers after the first cover has been moved a distance in the first direction; and preventing developer flow between the developer cartridge and the developer hopper with a sealing member disposed therebetween, the sealing member having a first overall height when the covers are in the closed position and having a second overall height when the covers are in the open position.

3. A method for delivering a developer contained in a developer cartridge to a developer hopper of an electro-photographic machine, the method comprising:

directly moving a first cover from a closed position to prevent delivery of the developer to an open position to deliver the developer;

indirectly moving a second cover in contact with the developer from the closed position to the open position via first cooperating features of the first and second covers, the first cooperating features comprise stepped portions; and preventing developer flow between the developer cartridge and the developer hopper with a sealing member disposed therebetween, the sealing member having a first overall height when the covers are in the closed position and having a second overall height when the covers are in the open position.

4. The method according to claim 3, wherein indirectly moving the second cover comprises indirectly moving the second cover from the open position to the closed position via second cooperating features of the first and second covers.

5. The method according to claim 4, wherein the second cooperating features comprise a void and a protrusion.

6. A developer cartridge for containing a developer and for delivering the developer to a developer hopper of an electro-photographic machine, the developer cartridge comprising:

a developer containment portion including a first portion having an at least partially closed volume configured to contain the developer and a second portion adjacent the first portion and having an opening configured to deliver the developer to the developer hopper;

a sealing gasket disposed adjacent the second portion of the developer containment portion and surrounding at least a portion of a circumference of the opening; and a first cover disposed adjacent the second portion of the developer containment portion and positionable between an open position for delivery of the developer and a closed position for preventing delivery of the developer, wherein the sealing gasket contacts the first cover to prevent leakage of the developer therebetween, and wherein the sealing gasket has a first overall height when the first cover is in the closed position and a second overall height when the first cover is in the open position.

7. The developer cartridge according to claim 6, further comprising:

a cover channel disposed adjacent to and integral with the second portion of the developer containment portion, wherein a portion of the first cover is disposed in the cover channel.

8. The developer cartridge according to claim 7, wherein the cover channel comprises a C-shaped channel.

9. The developer cartridge according to claim 8, further comprising:

a second cover disposed in the cover channel adjacent to the exterior of the developer cartridge and positionable between an open position and a closed position, the second cover cooperating with the first cover such that positioning the second cover in the open position forces the first cover into the open position.

10. The developer cartridge according to claim 9, wherein the first and second covers include corresponding first cooperating features.

11. The developer cartridge according to claim 10, wherein the corresponding first cooperating features include cooperating stepped portions on the first and second covers.

12. The developer cartridge according to claim 9, wherein the second cover cooperates with the first cover such that positioning of the second cover in the closed position forces the first cover into the closed position.

13. The developer cartridge according to claim 12, wherein the first and second covers include corresponding cooperating features.

14. The developer cartridge according to claim 13, wherein the corresponding cooperating features include a corresponding void and a protrusion.

15. The developer cartridge according to claim 14, wherein the first cover includes the protrusion and the second cover includes the void.

16. The developer cartridge according to claim 15, wherein the protrusion is configured to unlock a shield member of the developer hopper that permits access to an interior thereof.

17. The developer cartridge according to claim 16, further comprising:

a sealing gasket channel disposed in the second portion of the developer containment portion, wherein the sealing gasket is disposed in the sealing gasket channel.

18. The developer cartridge according to claim 9, further comprising:

a pull handle operatively connected with the second cover such that pulling of the pull handle positions the second cover in the open position.

19. The developer cartridge according to claim 6, wherein the sealing gasket remains in contact with the first cover during an entire range of movement of the first cover between the open and closed positions.

20. The developer cartridge according to claim 6, wherein the first overall height is less than the second overall height.

21. The developer cartridge according to claim 6, wherein at least a portion of the sealing gasket expands when the cover is moved from the closed position to the open position.

22. The developer cartridge according to claim 6, wherein at least a portion of the sealing gasket is compressed when the cover is moved from the open position to the closed position.

23. The developer cartridge according to claim 6, wherein the sealing gasket expands when the cover is moved from the closed position to the open position, and the sealing gasket is compressed when the cover is moved from the open position to the closed position.

* * * * *